US006494608B1

(12) United States Patent
Retamal et al.

(10) Patent No.: US 6,494,608 B1
(45) Date of Patent: Dec. 17, 2002

(54) SYSTEM FOR THE CONTINUOUS AND AUTOMATIC PRODUCTION OF AUTOMOTIVE AND OTHER PAINTS CAPABLE OF HANDLING A PLURALITY OF DIFFERENT PAINTS

(75) Inventors: Antonio Retamal, São Paulo (BR); Rogério Batista Auad, São Paulo (BR)

(73) Assignee: Renner du Pont Tintas Automotives e Industriais S/A (BR)

( * ) Notice: Subject to any disclaimer, the term of this patent is extended or adjusted under 35 U.S.C. 154(b) by 0 days.

(21) Appl. No.: 09/402,437

(22) PCT Filed: Dec. 10, 1998

(86) PCT No.: PCT/BR98/00099

§ 371 (c)(1),
(2), (4) Date: Oct. 7, 1999

(87) PCT Pub. No.: WO99/41003

PCT Pub. Date: Aug. 19, 1999

(30) Foreign Application Priority Data

Feb. 13, 1998 (BR) ..... 9800361

(51) Int. Cl.[7] ..... B01F 15/02

(52) U.S. Cl. ..... 366/132; 366/134; 366/136; 366/138; 366/140; 366/152.1; 366/153.1; 366/160.3

(58) Field of Search ..... 366/131, 132, 366/134, 136, 137, 138, 140, 141, 142, 151.1, 152.1, 152.6, 153.1, 159.1, 160.1, 160.2, 160.3, 162.1, 348, 605

(56) References Cited

U.S. PATENT DOCUMENTS 1,781,435 A * 11/1930 Carper
3,208,829 A * 9/1965 Terenzi
3,244,407 A * 4/1966 Obergfell et al.
3,425,667 A 2/1969 Schutte et al.
3,769,232 A * 10/1973 Houldridge
3,830,473 A 8/1974 Lieferman et al.
4,096,586 A * 6/1978 Badertscher et al. ..... 366/136
4,171,224 A * 10/1979 Verhille et al.
4,212,545 A * 7/1980 Lovasz et al. ..... 366/132
4,299,501 A * 11/1981 Patil et al. ..... 366/136
4,403,866 A 9/1983 Falcoff et al. ..... 366/132
4,407,431 A * 10/1983 Hutter, III ..... 366/137
4,857,355 A * 8/1989 Gregg ..... 366/136
5,348,390 A * 9/1994 Schertenleib ..... 366/136
5,511,876 A * 4/1996 Plessers et al. ..... 366/153.1
5,522,660 A * 6/1996 O'Dougherty et al. ..... 366/136
5,590,960 A 1/1997 Clinton et al.
5,632,960 A * 5/1997 Ferri, Jr. et al. ..... 366/153.1

* cited by examiner

*Primary Examiner*—Charles E. Cooley
(74) *Attorney, Agent, or Firm*—Ostrolenk, Faber, Gerb & Soffen, LLP

(57) ABSTRACT

A system which continuously automatically produces paint, particularly for automotive applications, includes tanks of raw materials which are constructed to supply resins, paint concentrates, paint additives, and paint solvents in a fully automated and continuous matter, which results in the production of paints substantially without manual intervention. The system includes a main circulation system which receives the metered dosages of raw materials automatically, collects the raw materials in mixing tanks and which includes outlet pipes which direct the mixture towards a main mixer. The paint is directed to a storage tank, with a portion of the paint being diverted to a control cell which samples the paint and analyzes it and derives from it parametric information which is compared to prestored criteria and which serves to adjust the properties of the ultimately obtained paint as to color, coverage and viscosity. An internally provided cleaning system uses pressurized nitrogen to push remnants of the paint from the pipes and associated equipment at the conclusion of the production of a given paint to prepare the system for the production of a paint having different characteristics, ingredients, and raw materials.

7 Claims, 7 Drawing Sheets

47
51
53
NOZZLES
52
62
73
61
72
50
70
59
22
40
41
48
21
MIXER
76
49
71
60
COLORIMETER
46
42
44
45
43

SYSTEM FOR THE CONTINUOUS AND AUTOMATIC PRODUCTION OF AUTOMOTIVE AND OTHER PAINTS CAPABLE OF HANDLING A PLURALITY OF DIFFERENT PAINTS

BACKGROUND OF THE INVENTION

This concerns the development of a process which assures color uniformity, texture and viscosity in the production of paints specially for painting of metal objects, more specifically, car bodies.

Presently, the manufacture of paint by the conventional method involves a quite complex process and is formed by the following phases: weighing of the raw material, preparation, adjustment of color, coverage, adjustment of viscosity, quality control, canning and packaging. The raw materials which are necessary to produce a given color of paint are weighed in the quantities mentioned in a formula, placed on a pallet and taken, by the lifting truck, to the paint manufacturing plant which is awaiting the starting of the production. The raw materials, either solid or liquid, are weighed in different places, far from the production line, and we should point out that the accuracy of such weighed quantities depends upon the scales used which, in turn, should constantly be gauged so that precise results may be achieved in the weighing operations. Some raw material, which are added in large quantities (such as resins and solvents), are taken at the plant preparation area.

All raw materials which arrive at the preparation area are kept in tanks located in dikes. Each tank has its own pump which is driven by the respective feeding valve for raw materials and which is located in the piping which reach the plan, and in said piping system there is coupled a single flow meter which controls the quantity of the raw materials which have to be added to the mixing tank.

Initially, the operator connects one end of a hose to the pipe of the product which is to be added while the other end of the hose is placed against the mouth of the mixing tank, in such a way that in order to unload the raw material, the operator marks in the meter the quantity in weight (Kg) of the product and opens the feeding valve; the valve sends an electric signal to the pump (located in the dike) turning it on and transferring the product from the outside storage tank to the mixing tank, located at the plant and, in this manner, as soon as the quantity marked in the flow meter is reached the pump is automatically turned off.

The preparation phase consists of the addition, one by one, of the raw materials, following a given order and starting always with the products of larger quantity, followed by those of small quantity, with the resin being the first product to be added in the mixing tank, without stirring. It should be noted that if the resin is stored in drums, the operator should use a drum tumbler, which is kept in an appropriate place, taking it next to the mixing tank in order to proceed with the unloading of the resin and, if said resin is taken directly from the pipe system existing in the plant, the procedure is practically the same for the weighing or, if there is a pipe system feeding the plant, the addition process through the flow meter, as mentioned above.

Other products (additives) are added also by hand and under stirring, using pails and cans.

The whole addition work described above takes approximately 4 hours.

The dying or color adjustment process is performed by the manual addition, with use of pails, of the dying additives, with the color technician weighing first the empty pails where the dyes are placed and weighing the pails again when full, in order to identify the volume of concentrate materials which are placed in the tank under stirring, until reaching the appropriate color, with the pails being weighted once again in order to define the exact quantity which was added.

Then a small sample of the paint is taken to the quality control laboratory, which paints a small plate at the painting cabin, with said plate being dried, in open air, for 5 to 30 minutes, and than in a stove, at 60 to 180° C. for 10 to 30 minutes, waiting the cooling down of the plate and comparing it with a standard sample, either visually or through instruments. If the color is not within the required standards, the color technician makes the necessary adjustments and repeats the procedure in order to adjust the color until the paint is within the referred standards. Normally, in order to adjust the color, the color technician repeats from 3 to 4 times the above mentioned process and this takes, on average, 4 hours. It should be pointed out that if the color technician adds the wrong dye or in an exaggerated amount, it is impossible to adjust the color and, therefore, the whole lot is lost.

After the adjustment of the color a sample is taken and sent to the quality control department for the adjustment of viscosity and tests. The viscosity adjustment is made on the sample and performed through the identification of the volume of solvent contained in said sample, when the total volume of solvent to be added to the mixing tank is computed.

In this phase, the operator should bring the solvent to adjust the viscosity, weighing the solvent in pails, cans or drums (depending upon the quantity of solvent to be added) and pouring it into the mixing tank. If the use of drums is necessary, a drum tumbler equipment should be used, which is kept in an appropriate place, taking it next to the mixing tank in order to proceed with the unloading of the solvent.

In order to wash the tank or bowl, the operator fills a can with cleaning solvent, taken from the closest solvent pipe, pours it by hand and cleans the walls with a brush. After this starting work, the operator pours more solvent in order to rinse, and this dirty solvent, which comes from the tank or bowl, is drained through a draining cock into a drum, which is taken to the shipping platform of the plant in order to be removed to the so called "solvent recuperating" plant, which distills and recovers the solvent, which is returned to the plant through a pipe system, to be used again.

When the paint is ready, a sample is taken and sent to the quality control department, where the following tests are performed: color, coverage, solids, specific weight and viscosity. Presently, these tests are performed as follows:

Color: is the determination of differences in shade between a film and its respective standard, when looked under natural light and in which a sample is taken out, the viscosity is adjusted and the paint is applied on a steel plate, awaiting for 15 minutes to evaporate the light solvents and, after said period of time, the sample is placed on a stove under 60° C. for 30 minutes. The average time for the test is of 1 (one) hour, but in the case of white synthetic enamel, the color technician needs 16 hours for the drying of the paint in open air, and it may take up to 5 days in order to adjust the color and to finish the tests.

Specific weight: used for the determination of the specific mass of liquid paints, solutions and dispersions, the result of which is expressed in $g/cm^1$, being traditionally referred to as density: the method is based upon the relationship between mass of a substance and its volume.

For this, a container, the volume of which is known, is filled with a sample at 25° C., the container is weighed obtaining the specific weight, with the average time spent to perform the test being approximately 10 minutes.

Solids: is the percentage of solid material existing in a paint. The content of non volatile material in a product is not an absolute quantity, but depends upon the temperature and time of heating used; the recommended temperature and time is 120° C. for 1 hour of stove, and, in this method a fixed quantity of the product is weighed, spread in a container and taken to a stove for 1 hour, after said period, the sample does to the drying oven for 30 minutes and then is weighed in a laboratory scale in order to obtain the percentage of solid material; the average time for said tests is 2 hours. If the percentile value of solids is out of the specified standards, the adjustment is made with the addition of resin or dyes and if during said addition a larger quantity is used, the whole lot is rejected.

Viscosity: in a quite empirical way, it is possible to say that viscosity is the difficulty a liquid offers against its flowing; the method is based upon the flowing time of a continuous flow of a liquid at 25° C., through a given diameter hole called Ford 4 glass, and if the solvent is added in large quantities, it is also impossible to adjust the viscosity, therefore losing the whole lot.

Said test takes approximately 30 minutes to be performed.

After the approval by the Quality Control department, the approved paint is placed in cans and then packaged, by hand. The filling of containers may be performed in any quantity, depending on the machine to be used.

The average time needed to achieve the analysis for color, viscosity, solids and specific weight, considering the total time from the moment taken from the production sector, time awaiting for the tests in the laboratory, until the final answer from the Quality Control Laboratory to the production department is of approximately 4 hours.

We should point out further that if the addition of dyes, solvents or resins for the adjustment of color, viscosity and solids are performed in non appropriate quantities by the operator or color technician, it is possible to lose the whole lot, which will be totally eliminated, made by different persons and, considering that there are the aspects of training, capacity, interpretation of results, the analysis depend also of the gouging of the instruments and quality of the laboratory equipment. Finally, there is a series of factors which may affect significantly the results, with implications in quality and in the cost of production.

SUMMARY OF THE INVENTION

In the present invention, the continuous and automatic process for the production of automotive paints and others is constituted by a process which produces automatically any type of paint, strictly within the standards specified in the formulae, complying with the requirements of color, coverage, solids and viscosity, allowing also the automatic change of color or type of paint in approximately 3 minutes. The packaging may be made with any volume, depending on the machine to be used for such a work.

For the manufacture of certain types of paint, the mixture of materials is taken into one of the two mixing tanks; while a mixing is loaded and mixing the mixture of the other tank is being continuously pumped into the head of the mixer, which has high speed stirring. Other materials required for the final paint (additives and dyes) are simultaneously pumped within the mixing head in order to be mixed with products of different tanks of raw material. We call raw materials the resins, the concentrates, solvents and additives which are used for the production of paints.

The paint, after being ready, passes through a probe which reads the color and viscosity and then is loaded into cans or drums (0.9, 1.0, 3.6 and 4.0 litters or other volumes) ready for delivery.

The whole manufacture process for paint is performed by the PLC (Programmable Logic Controller) and the system in controlled by the supervisor systems through the LLX-DMACS software, where all necessary information are stored and then used and with said system monitoring the following parameters: Color, Coverage, Viscosity, Specific weight, Pressure, Flow, Dying power of the concentrated.

In summary, this process has the following characteristics: it produces automatically the paint in the specified color and makes the automatic cleaning in approximately 3 minutes. In other words, all pipes, tanks, valves and equipment are totally cleaned in this short period of time and, with this, allows a fast changing of paint (changing the color and/or type of resin) in respect to conventional methods, with great flexibility in the production of paints. Namely, it is possible to produce any color of paint in any resin contained in the tanks of raw materials, without the smallest possibility of contamination of one paint with the other, with the whole color, coverage and viscosity control being performed on line.

Being continuous, the system has the flexibility to produce from small lots up to large ones.

It performs instantaneously the tests of color, solids, viscosity, specific weight along the whole manufacture process, with the tests being performed as the paint is produced. The time for the preparation of the system in order to produce a new lot is extraordinarily small in respect to the conventional process, due to the fact that the system performs the automatic cleaning.

With this system it is possible to achieve perfect reproductions of paints, namely, the process produces always the same paint, as per the standards specified in the formulation.

Considering that this process is made in a continuous and automatic manner, the adjustments are performed with the addition in the exact proportions and continuously, thereby eliminating the addition in larger quantities than the necessary ones and eliminating also eventual problems with the quality of the paint.

Due to the fact that the process is continuous and automatic, there is no need to obtain samples for the laboratory in a manual way, with all the inconvenience mentioned above.

Another important benefit of being a continuous and automatic process is that it is possible to use automation related resources, such as alarms, indication of instant reading, graphs of the parameters, reports, accrued values along the time, history, trends, etc., with the power to speed up and optimize the maintenance of the system providing events based in historic facts, filing problems or changes occurred in the systems etc.

Great reliability of the measuring system, for this being a continuous and automatic system independent of outside variables, such as the waiting time to perform the tests, contamination, etc.

The system is possible to monitor, for all stages of the process and all parameters are duly known and controlled.

The system does not require the same number of operators for maintenance, nor the need of maintaining a laboratory with sophisticated equipment, for the controls are performed on line.

With this process, a great loss of time is avoided in the movement of raw materials for the addition of the products, as it is done in the conventional processes.

Due to the fact that the process is fully automatic, the personnel used in the operation of the plant becomes more specialized and therefore qualified to perform any repair in the plant.

BRIEF DESCRIPTION OF THE DRAWINGS

For a better understanding of the objects of this invention, we refer to the following drawings, where.

DETAILED DESCRIPTION OF THE DRAWINGS

Figure 1:
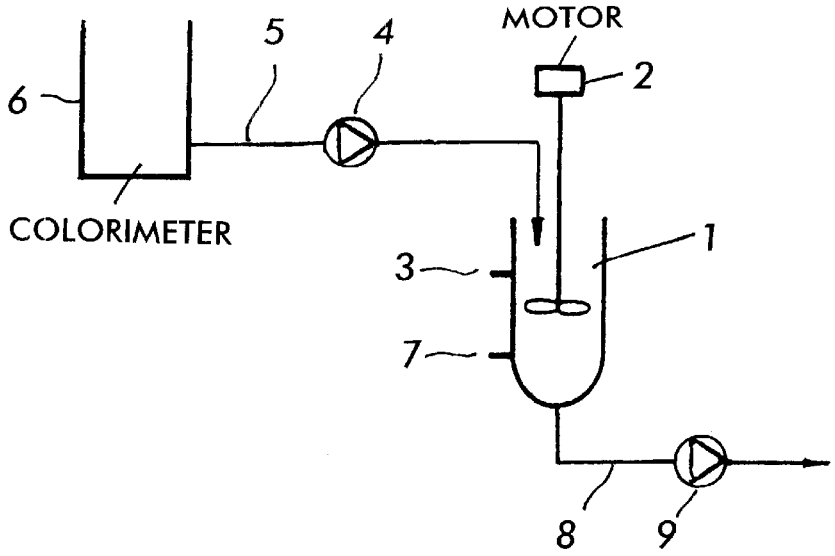
FIG. 1 shows a diagram of the simplified flowchart for the process of loading the tanks with raw materials.
Figure 2:
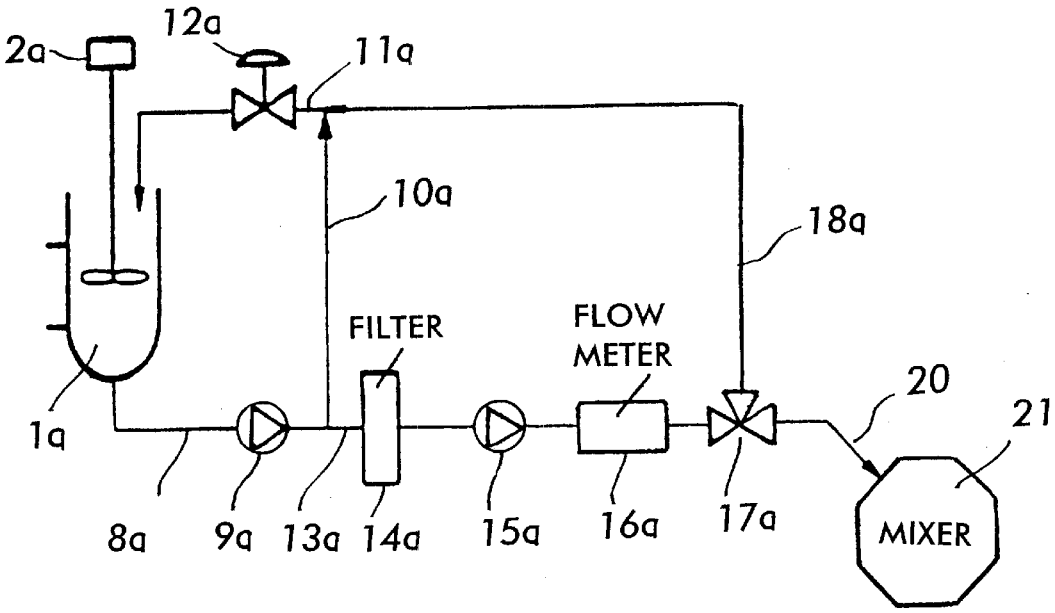
FIG. 2 is a diagram of the simplified flowchart for the process of addition of resins "A" to the mixing tank.

This invention comprises several feeding lines of raw material, with such lines being basically formed by tanks (1) for the loading of raw materials which have the necessary stirrer motor (2) to homogenize said raw materials and the high level control (3) which, when the tank (1) reaches the required filling level, connects the high level transmitter which disconnects, automatically (through a software), the feeding pump (4) in order to stop the transfer of the raw material through the pipe (5) from the tank, bowl or other container (6) and controls the low level (7) which, when the tank is in its low level, connects the transmitter in order to turn the pump (4) on, which transfers through said pipe (5) the raw material from the tank (6) into the tank (1), pointing out that under normal conditions of operation, all raw materials connected to the production of a given paint are simultaneously and automatically added. Also note the pipe (8) and the dosing pump (9).

Figure 8:
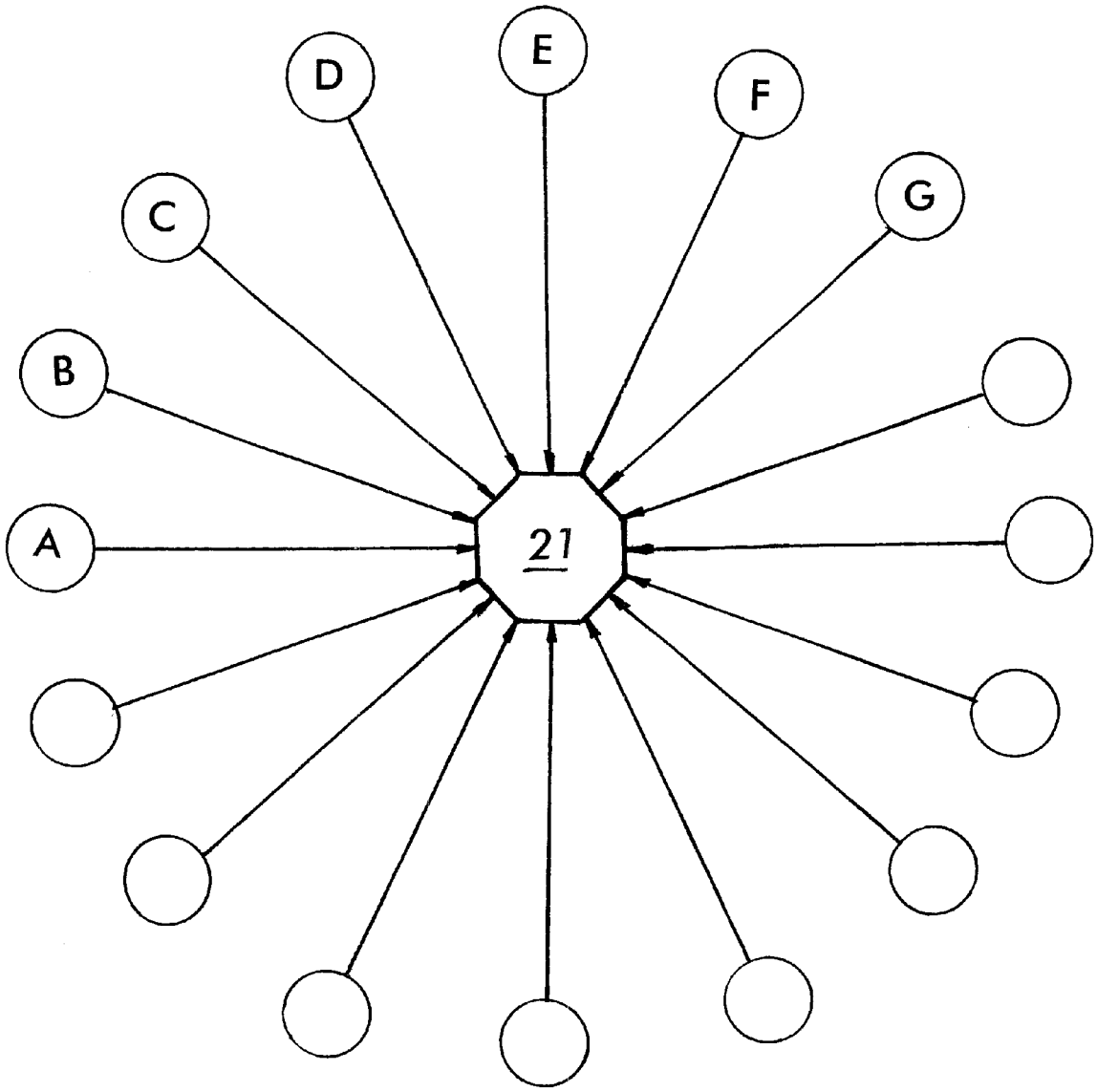
FIG. 8 shows a diagram of a simplified flowchart of the reception process for raw materials in several tanks of the mixer, for the mixing, analysis of their characteristics and following to the packaging station.
Figure 9:
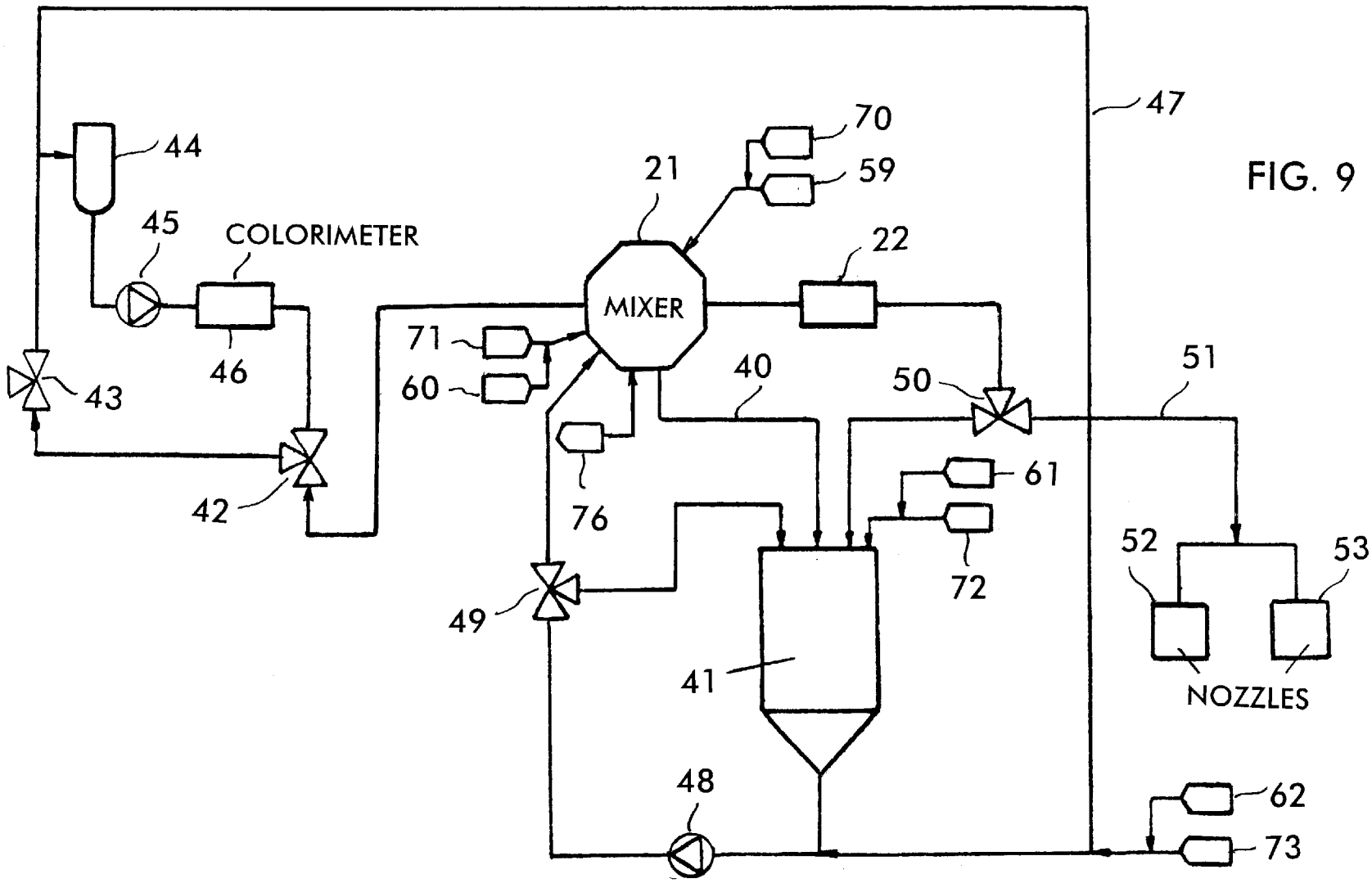
FIG. 9 shows a diagram of a simplified flowchart of the whole set, from the mixer to the later stages.
Figure 10:
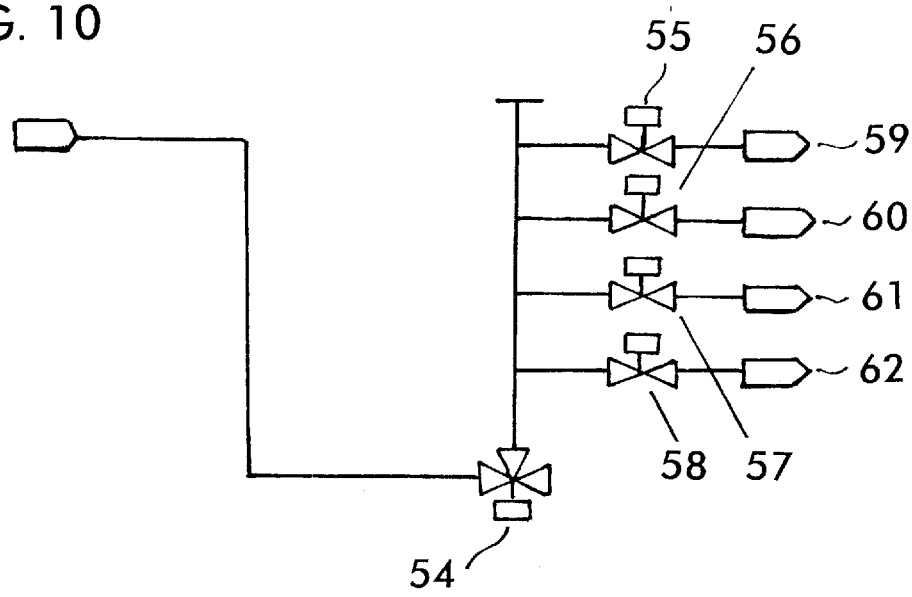
FIG. 10 shows a diagram of a simplified flowchart of the reception of nitrogen in the cleaning system, which pushes the paint present within the pipes and in the mixer.
Figure 11:
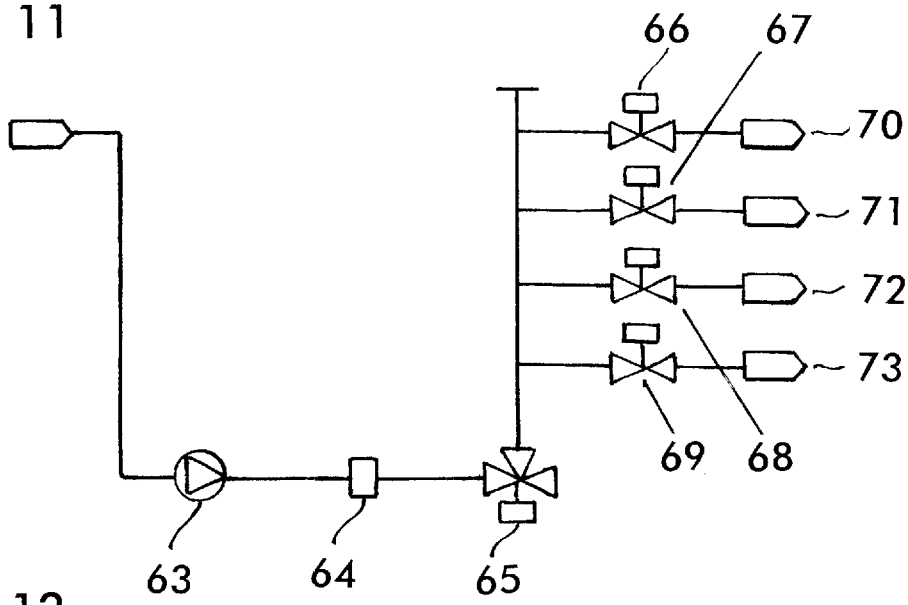
FIG. 11 shows a diagram of a simplified flowchart for the reception of clean solvent of the cleaning system.
Figure 12:
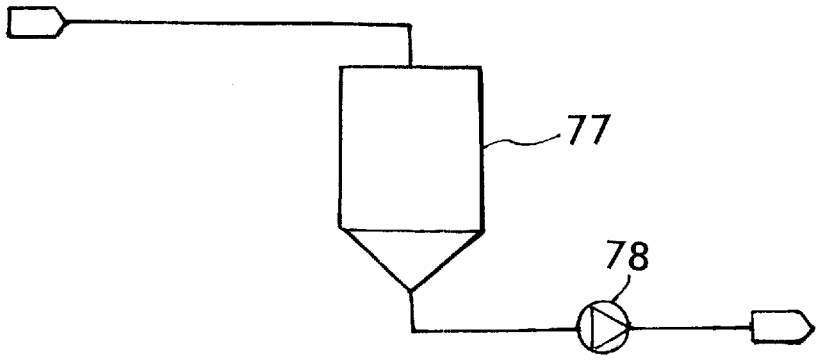
FIG. 12 shows a diagram of a simplified flowchart for the taking out of dirty solvent from the cleaning system.

In the process for the addition of resins (A) (FIG. 8), the recirculation of the resin is started, namely, the resin exits from one of the tanks (1*a*) with a stirrer (2*a*) and through the pipe (8*a*) passes by a dosing pump (9*a*) which is automatically turned on when the system reaches a previously determined pressure, and by a duct (10*a*) in order to communicate with the duct (11*a*) with a control valve (12*a*) and returning into the tank (1*a*) with the pressure of the first recirculation loop being controlled through the opening or closing of said control valve (12*a*) and, in this phase, the recirculation of the resin is started in the second loop, which is formed by the pipe (13*a*), filter (14*a*), dosing pump (15*a*), flow meter (16*a*), diversive valve (17*a*) which returns the resin by a pipe (18*a*) which, its turn, is connected to the pipe (11*a*) and which, passing through the control valve (12*a*), returns to the tank (1*a*) or through the pipe (20*a*) going to the mixer (21); said dosing pump (15*a*) has a variable rotation allowing a variable flow to reach the specified quantity of resin as per the respective paint formulas, with the quantity of resin to be added in the mixer (21) being controlled by the flow meter (16*a*) which controls the rotation of the dosing pump (15*a*) which, as the total quantity of resin determined for the production of the lot is introduced into the system, the adding pumps (9*a* and 16*a*) of the resin tank will be turned off automatically.

Figure 3:
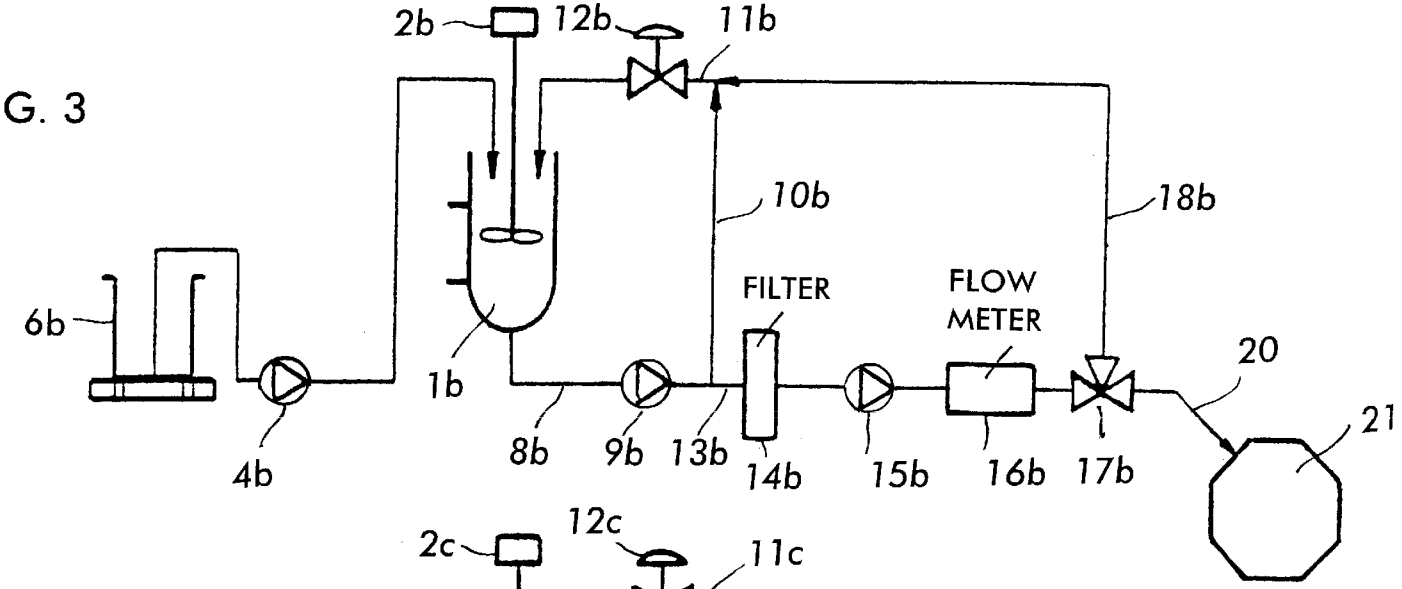
FIG. 3 shows a diagram of a simplified flowchart of the addition process for additives "B" in the mixing tank.

In the process for the addition of dyes (B) (FIG. 8) which are stored on another tank (1*b*) (FIG. 3) with 20, 1,000 and 2,500 litters capacity and with a stirrer (2*b*), after being taken from the bowl (6*b*) by the feeding pump (4*b*) enters first into recirculation, coming out from the tank (1*b*), passing by the pipe (8*b*) and through the dosing pump (9*b*) which is automatically turned on when the system reaches a previously defined pressure and by the pipe (10*b*) in order to connect with the pipe (11*b*) with the control valve (12*b*) in order to return to the tank (1*b*), with the pressure of this first loop being controlled through the opening or closing of the control valve (12*b*) and, in this phase, the recirculation of the concentrated in the second loop starts, which is formed by the pipe (13*b*), basket filter (14*b*), dosing pump (15*b*), flow meter (16*b*) and diversive valve (17*b*), which returns the concentrate by a duct (18*b*) which, in turn, is connected with the pipe (11*b*) and which, passing by the control valve (12*b*) returns to the tank (1*b*) or through the pipe (20) goes to the mixer (21); said dosing pump (15*b*) has variable rotation allowing the variable flow in order to reach the quantity of concentrate specified in the respective formulas of paints, with the quantity of concentrate to be added in the mixer (21) being controlled by a flow meter (16*b*) which controls the rotation of the dosing pump (15*b*) and the quantity of concentrates which have to be introduced into the system controlled by the control loop which reads the color on-line and corrects instantaneously with the addition of concentrates inherent to the respective formula and, as the whole quantity of concentrate determined for the production of the lot is introduced into the system, the addition pumps (9*b* and 15*b*) of the dye tanks are automatically turned off.

Figure 4:
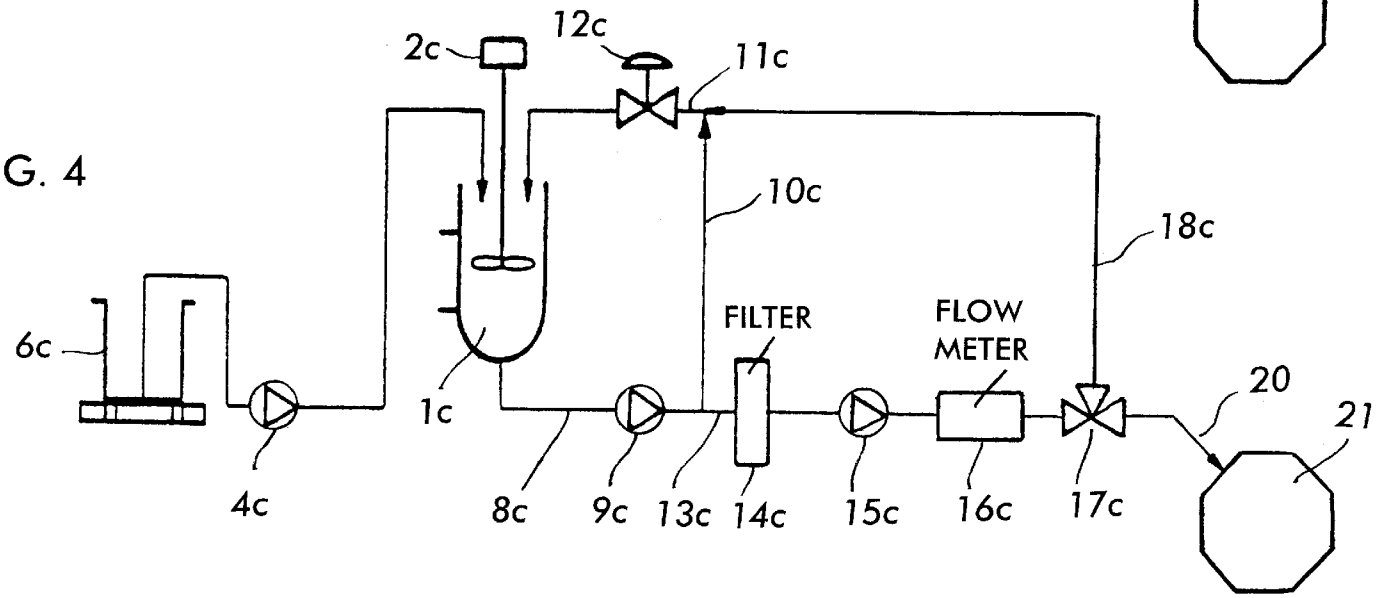
FIG. 4 shows a diagram of a simplified flowchart of the addition process for dyes "C" in the mixing tank.

In the addition process for additives (C) which are stored in another tank (1*c*) of 20, 1,000 or 2,500 litters capacity and with motor stirrer (2*c*) (FIG. 4) which, after being taken from the bowl (6*c*) using a feeding pump (4*c*) enters initially in recirculation, namely, it exits the tank (1*c*), passes by the pipe (8*c*), by the dosing pump (9*c*) which is automatically turned on when the system reaches a previously defined pressure and by a pipe (10*c*) in order to connect with the pipe (11*c*) with the control valve (12*c*) in order to return to the tank (1*c*), with the pressure of this first loop being controlled through the opening or closing of the control valve (12*c*) and, in this phase, the recirculation of the concentrated in the second loop starts, which is formed by the pipe (13*c*), basket filter (14*c*), dosing pump (15*c*), flow meter (16*c*) and diversive valve (17*c*), which returns the additives by a duct (18*c*)

which, on its turn, is connected with the pipe (11*c*) and which, passing by the control valve (12*c*) returns to the tank (1*c*) or through the pipe (20) goes to the mixer (21). The dosing pump (15*c*) has variable rotation allowing the variable flow to reach the quantity of additives specified in the respective formulas of paints, with the quantity of additives to be added in the mixer (21) being controlled by a flow meter (16*c*) which controls the rotation of the dosing pump (15*c*) and the quantity of additives which have to be introduced into the system controlled by the control loop which reads the color on-line and corrects instantaneously with the addition of additives inherent tot he respective formula and, as the whole quantity of additives determined for the production of the lot is introduced into the system, all addition pumps (9*c* and 15*c*) of the dye tanks will be automatically turned off.

Figure 5:
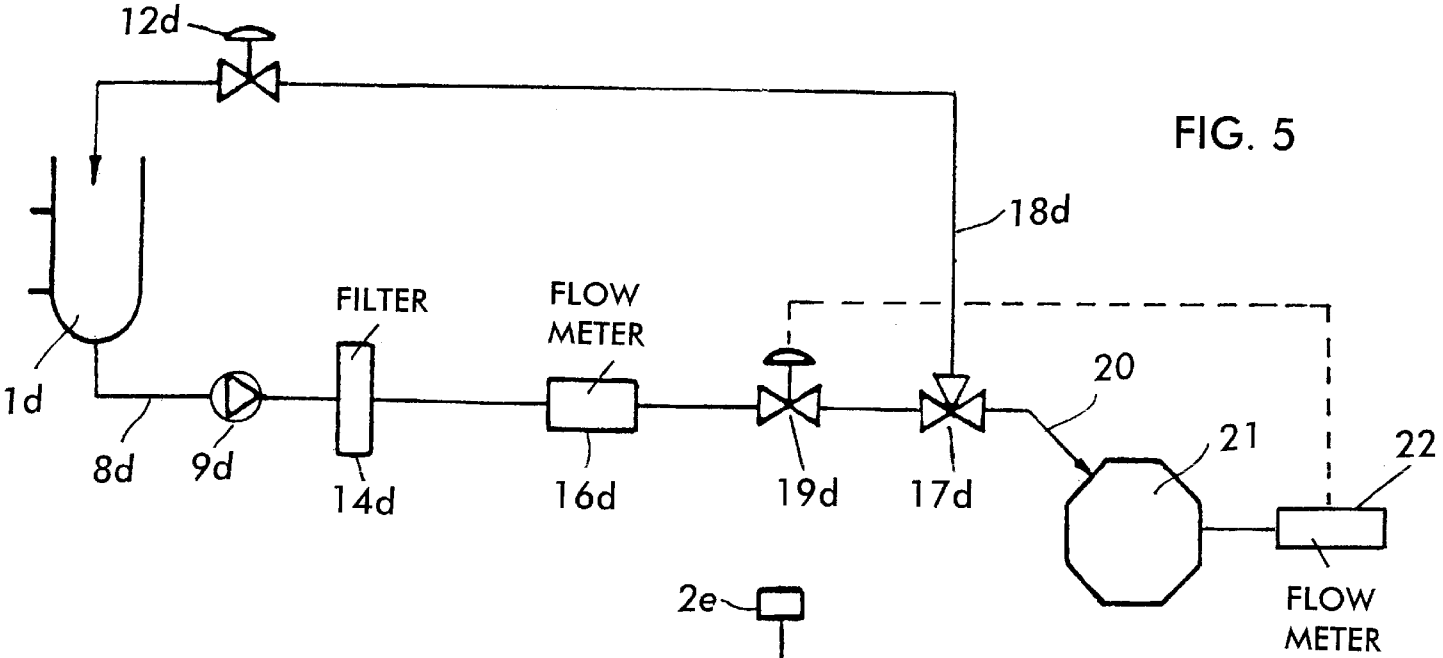
FIG. 5 shows a diagram of a simplified flowchart of the addition process for solvents "D" in the mixing tank.
Figure 6:
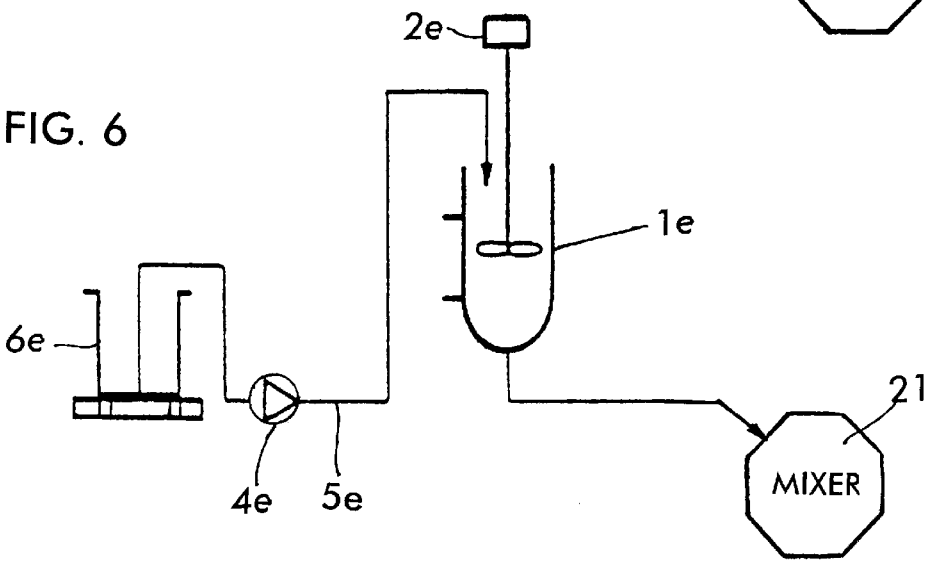
FIG. 6 shows a diagram of a simplified flowchart of the addition process for small quantities of raw materials "E" taken from the mixing tank.
Figure 7:
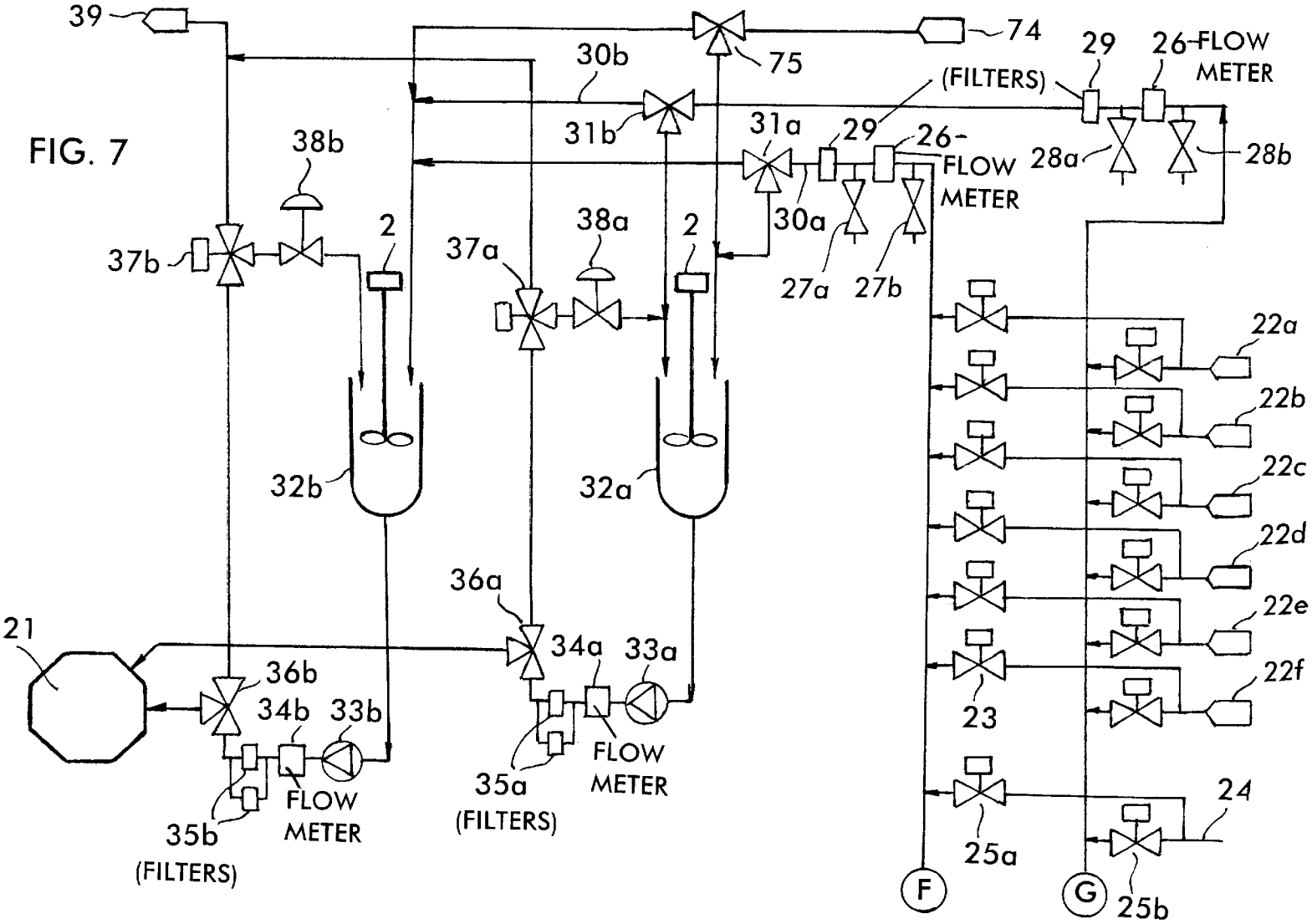
FIG. 7 shows a diagram of a simplified flowchart of the addition control system for several raw materials in to two mixing tanks, before being placed in the mixer the system needed to obtain certain types of paints.

In the addition process for additives (D) which are stored in another tank (1*d*) which is automatically loaded by PLC with the solvent coming out from the pipe (8*d*) (FIG. 5) being pumped, by the centrifuge dosing pump (9*d*), passing through the basket filter (14*d*), by the flow meter (16*d*) and control valve (19*d*), until the pressure reaches a previously established value, with said pressure being adjusted until reaching a value programmed by the valve (12*d*) and then the valve (17*d*) which sends the flow through the pipe (18*d*) by the valve (12*d*) back to the tank (1*d*) and, upon changing the position (from ac to ab) and the solvent starts entering the mixer (21) and, in this stage, a fine adjustment of the flow will be made with the quantity of solvent being controlled by another flow meter (22) which sends instantaneously the viscosity value of the solvent to the program and this sends a signal to the control valve (19*d*) to open or close and, in this way, to control the viscosity specified in the formulation, in such a way that when the raw materials are finally introduced in said mixer (21), the whole lot of paint already established was produced with the system turning off automatically.

For the feeding of small quantities of raw materials (E) and for the adjustments of the mixer (21), a dispersion tank (1*e*) receives, through the pipe (5*e*) and the pump (4*e*) the raw material taken from the drum or bowl (6*e*).

Optionally, for the preparation of some types of paints, the process of the balanced mixture of raw materials may be divided into two feeding lines (F and G) which receive, alternately and independently, the introduction of the raw materials (22*a*, 22*b*, 22*c*, 22*d*, 22*e*, 22*f* . . . ), processed by pumps controlled by the PLC, through the on-off valves (23*a*, 23*b*, 23*c*, 23*e*, 23*f*, . . . ) and of resin (24) through the valves (25*a*) and (25*b*), which shall be automatically dosed by the flow meter (26) which are self adherent and the drains of which (27*a*), (27*b*), (28*a*) and (28*b*) serve to calibrate said meters (26) and filters (29*a*) and (29*b*) and through the pipes (30*a*) and (30*b*) and 3 way valves (31*a*) and (31*b*) which feed the mixing tanks (32*a* and 32*b*), not dedicated, each one with a motor stirrer (2), with said tanks having a lower outlet pipe though the gear pump (33*a*) and (33*b*) and flow meters (34*a*) and (34*b*) and two basket filters assembly in parallel (35*a*) and (35*b*) and connected in a 3 way valve (36*a*) and (36*b*) (which send the mixture to the main mixer (21) or which direct the mixture to 3 way valves (37*a*) and (37*b*) and to the pressure control valves (38*a*) and (38*b*) and bringing the mixture back to the mixing tanks (32*a*) and (32*b*) or, when the cleaning process, takes the dirty cleaning solvent to the outlet (39).

A semi-loading system may be placed in the two feeding lines (F and G) of the mixing tanks (32*a* and 32*b*), with such system being formed by drums, gear pumps and basket filter, where the quantity of raw materials manually measured through the weighing in scale with the raw materials being added in the mixing tanks (32*a* and 32*b*), through the pumping or manual unloading through the funnel installed in the mouth of the tanks.

The mixer (21) is a compact equipment and is provided with several independent inlet nozzles through which several raw materials are introduced within the inner mixing chamber, which has a defined minimum volume, necessary for a perfect homogenization of the raw materials, forming therefore the paint, with the paint produced coming out through the pipe (40) and enters the storage tank (41), with part of the paint being formed in said mixer (21) going to the control cell, composed by the deversive valves (42) and (43) by a small tank (44), a pump (45) and a calorimeter (46), where the color and coverage is analyzed, with the paint returning to the storage tank (41) through the pipe (47) and the data so obtained being then sent to the program which compares with the standard paint in order to add the necessary raw materials to adapt the color and coverage, until reaching the specified standards, with said program adding the flow meter (22) which reads the viscosity and sends the data to the program which, on its turn, compares with the viscosity specified and orders the addition or restriction of the quantity of solvent in order to adjust the viscosity which, if is out of the standards, will return to the tank (41) or if it has the standard viscosity and ready to be canned, the content of the storage tank (41) is unloaded through pipes by a pump (48) and valve (49) returning to the mixer (21) and from there through the flow meter (22) and, through pipes and the valve (50) and the discharge pipe (51) and discharging nozzles (52 and 53) may be packed in 0.9, 1.0, 3.6, 4.0, 200 litters or any other type of volume; after the end of the production of a given paint, the system is cleaned with solvent and dried with nitrogen automatically in 3 minutes, with the system remaining capable of producing a new lot of paint of any color or with any resin.

In the start up process, the materials from all tanks (32*a*), (32*b*) and all resin tanks (1*a*), of all dye tanks (1*b*), of all additive tanks (1*c*) and of all tanks of solvents (1*d*) are pumped and remain recirculating in the pipe systems until the pressure has reached a stable value being, then, the dosing system and feeding system using the adjustment of the last lot produced. The first paint in the mixer (21) is taken to the storage tank (41) (called also lung tank) and, when the paint becomes stable within the technical specification, the flow is turned to the discharging of the ready paint (52 and 53) in drums or cans and, during the process, the material of the storage tank or lung tank 941) is gradually pumped into the mixer head (21) until the volume of said tank reaches the zero level, before the end of the "production run", in a totally controlled manner.

The feeding of new colors required a 20 liter sample of the product, which is sent through the calorimeter (46) analyzers using the small tank (44) and the pump (45) with the system registering the new color, with the product being then produced through the normal sequence using the percentile value of the inlet formula as a starting point and the color registrations and viscosity which intend to reach.

After the discharge has completed, a portion of nitrogen from the storage tank and distributed by the pipes passes through the diversive valve (54), is inserted through individual valves (55), (56), (57) and (58) in the points (59), (60), (61) and (62) of the system to push the product of the pipes in the outlet of the mixer (21) and in the pipes, the clean solvent is then introduced from the storage tank which passes through the pump (63), filter (64), and diversive valve (65) and is inserted through the individual valves (66), (67), (68) and (69) in the points (70), (71), (72), (73) and (74), this last one passing through the pipe with the diversive valve (75) and passing into the mixing tanks (32*a*) and (32*b*), with the dirty solvent being taken out in the points (39) and (76) being placed within the storage tank (77) through the pump (78) taken for recuperation.

Periodically, the adjustment of the dosing pumps (15*a*), (15*b*), (15*c*), (9*d*), (33*a*) and (33*b*) in order to compensate the natural wear through a deviation of the outlets, using an hydraulic cylinder against a constant simulated pressures in the normal process; the time which the cylinder takes to run a given volume is measured and the flow x rotation curve stored in the control system are updated and, if the flow goes below a given value (maximum wear), the system informs the operator in order to process the change of said pumps (15*a*), (15*b*), (15*c*), (9*d*), (33*a*) and (33*b*).

What is claimed is:

1. A system for the continuous and automatic production of a variety of different automotive and other paints, the system comprising:

a tank, feeding lines and a feeding pump, the feeding lines feeding raw materials to the tank through the actior of the feeding pump;

a device for determining the filling level of the tank and for stopping the feeding of raw materials when a given filling level has been reached;

a low level control device which monitors when the tank has reached a given low level to turn on the feeding, pump to supply additional raw materials;

a stirrer for homogenizing the raw materials in the tank, and including a sufficient number of the feeding lines to feed different raw materials to continuously and automatically fully complete the process of the production of a variety of paints, substantially without human intervention;

a cleaning system for automatically circulating through all of the feeding lines and structural components of the system which contact the raw materials, a cleansing fluid which purges the raw materials associated with the production of a given paint before the commencement of the production of another paint;

a circulatory system connected to supply resins to the tank through at least one of the feeding lines and for recirculation of the resins, the circulatory system comprising:

a first loop comprising and connecting in a loop a resin dosing pump, a resin pipe, a resin control valve, and a returning feed pipe to the tank;

a pressure control device for the first loop for controlling the on and off condition of the resin control valve of the first loop;

a second loop comprising a second resin pipe, a second resin dosing pump, a resin flow meter and a diversive valve which circulates the resin through the second resin pipe, including by flowing the resin through a resin mixer; the second dosing pump having a variable rotation that allows a variable flow to reach specified quantities of the resin, dependent on corresponding formulas of paints, with the quantity of resin to be added in the resin mixer being controlled by a flow meter which controls the second dosing pump and which, as soon as the entirety of the quantity required resin is determined to have been introduced into the first circulatory system, closes off a resin tank.

2. The system of claim 1, further including a mixer connected to the feeding lines, the mixer being compact in size and having a plurality of independent inlet nozzles through which the raw materials are introduced from the feeding lines, the mixer having an inner mixing chamber with a defined minimum volume necessary for optimal homogenization of raw materials forming a given paint; a pipe coupling the mixer with a storage tank with the paint being directed into the storage tank through the pipe; paint being formed in the mixer also introduced into a control cell comprised of diversive valves and a further tank, and a further pump and a colorimeter effective for analyzing the color and coverage of a given paint and a structure for returning the paint to the storage tank to a further pipe;

a computer program which compares a standard paint formula with a measured paint formula to determine the adding of selected ones of the raw materials to obtain a given color and coverage for a given paint batch to meet specified standards;

the program being effective to control a viscosity specified and to control the addition or restriction of a quantity of solvent in order to adjust for viscosity within a given standard and if the standards are not met, to return paint in the storage tank through respective pipes to the mixer and via the mixer, through a flow meter and corresponding pipes and a further valve and a discharge pipe and discharging nozzles; and the cleaning system passing a solvent comprising nitrogen automatically within three minutes of the completion of the production of a given paint in a manner which leaves the system for production of paints sufficiently cleansed to produce any other color with any other resin combination.

3. A system for the continuous and automatic production of a variety of different automotive and other paints, the system comprising:

a tank, feeding lines and a feeding pump, the feeding lines feeding raw materials to the tank through the action of the feeding pump;

a device for determining the filling level of the tank and for stopping the feeding of raw materials when a given filling level has been reached;

a low level control device which monitors when the tank has reached a given low level to turn on the feeding pump to supply additional raw materials;

a stirrer for homogenizing the raw materials in the tank, and including a sufficient number of the feeding lines to feed different raw materials to continuously and automatically fully complete the process of the production of a variety of paints, substantially without human intervention;

a cleaning system for automatically circulating through all of the feeding lines and structural components of the system which contact the raw materials, a cleansing fluid which purges the raw materials associated with the production of a given paint before the commencement of the production of another paint;

a circulatory system connected to supply dyes to the tank through at least one of the feeding lines for the production of the paints, the circulatory system comprising:

a first loop comprising and connecting in a loop, a dyes tank, a first dye dosing pump, and a dye control valve; a dye bowl and a dye feeding pump for feeding dye from the dye bowl into the dyes tank; the first loop including dye feeding pipes and an automatic controller which controls the dye dosing pump when the first loop reaches a previously predetermined pressure and the feeding of dye being controlled by the turning on and off of the dye control valve;

a second loop comprising and connecting in a loop, a dye pipe, a dye basket filter, a second dye dosing pump, a dye flow meter and a dye diversive valve, and including a dye duct which connects the second loop with the first loop, the dye diversive valve also supplying a path for the dye to a dye mixer and the second dye dosing pump having a variable rotation which allows a variable flow of dye to reach a specified concentration of dye in dependence on a corresponding dye formula, the dye concentration in the dye mixer being controlled by the dye flow meter which controls he rotation of the second dye dosing pump; and a controller which determines and reads on-line the color and corrects instantaneously with the addition of different dyes, in order to achieve a desired color for a given paint and which automatically controls the first and second dye dosing pumps to achieve a given color and which automatically turns the first and second dye dosing pumps on and off as needed to achieve the specific color.

4. A system for the continuous and automatic production of a variety of different automotive an other paints, the system comprising:

a tank, feeding lines and a feeding pump, the feeding lines feeding raw materials to the tank through the action of the feeding pump;

a device for determining the filling level of the tank and for stopping the feeding of raw materials when a give filling level has been reached;

a low level control device which monitors when the tank has reached a given low level to turn on the feeding pump to supply additional raw materials;

a stirrer for homogenizing the raw materials in the tank, and including a sufficient number of the feeding line to feed different raw materials to continuously and automatically fully complete the process of the production of a variety of paints, substantially without human intervention;

a cleaning system for automatically circulating through all of the feeding lines and structural components of the system which contact the raw materials, a cleansing fluid which purges the raw materials a associated with the production of a given paint before the commencement of the production of another paint;

a circulatory system connected to supply paint additives to the tank through at least one of the feeding lines for the production of the paints, the circulatory system comprising:

a first loop comprising and connecting in a loop, an additives tank, a motor stirrer for the additives tank, an additives feeding pipe, an additives dosing pump and additives control valve, the additives control valve automatically controlling the additives dosing pump in response to sensing that the system has reached a predefined pressure, the first loop being supplied with the paint additives from a bowl and a feeding pump;

a second loop comprising an additives pipe, an additives basket filter, an additives dosing pump, an additives flow meter, and an additives diversive valve, the second loop being started when the predefine pressure has been reached and serving to return additives via an additives duct to the additives tank of the first loop;

the additives diversive valve being effective to selectively direct additives into a mixer; and the additives d sing pump of the second loop having a variable rotation allowing a variable flow in order to provide a quantity of additives specified in respective formulas of a given paint being processed, with a quantity of additives to be added into the mixer being controlled by a further flow meter which controls the rotation of the additives dosing pump of the second loop by reference to readings taken on-line concerning color and so as to instantaneously correct with the addition o more additives to attain a given color and other parameter qualities for the given paint and then automatically turn off the additive dosing pumps when the specified conditions have been reached.

5. A system for the continuous and automatic production of a variety of different automotive and other paints, the system comprising:

a tank, feeding lines and a feeding pump, the feeding lines feeding raw materials to the tank through the action of the feeding pump;

a device for determining the filling level of the tank and for stopping the feeding of raw materials when a given filling level has been reached;

a low level control device which monitors when the tank has reached a given low level to turn on the feeding pump to supply additional raw materials;

a stirrer for homogenizing the raw materials in the tank, and including a sufficient number of the feeding lines to feed different raw materials to continuously and automatically fully complete the process of the production of a variety of paints, substantially without human intervention;

a cleaning system for automatically circulating through all of the feeding lines and structural components of the system which contact the raw materials, a cleansing fluid which purges the raw materials associated with the production of a given paint before the commencement of the production of another paint;

a circulatory system connected to supply paint solvents to the tank through at least one of the feeding lines for adjusting the viscosity of final paint products, the circulatory system comprising:

a first solvent loop comprising and connecting in a loop, a solvent tank being coupled to a solvent pipe, followed by a centrifuge solvent dosing pump, passing through a solvent basket filter and via a solvent flow meter and a solvent control valve, and a further solvent valve and a still further solvent valve completing the first loop and operating such that the pressure in the first loop is adjusted until it reaches a value that is programmed by the further solvent valve; and a second loop comprising a solvent mixer connected via a solvent flow meter and said solvent control valve and said still further solvent valve to effect fine adjustment in the second loop and which serves to instantaneously send a viscosity value of the solvent to a computerized program which thereby controls the further solvent valve to open and close, and in this manner, control the viscosity specified in a given paint formulation, in such a way and in a manner so that when a plurality of raw materials are finally introduced into a paint mixer, the paint is produced in a given quantity and the entire system turns off automatically.

6. A system for the continuous and automatic production of a variety of different automotive and other paints, the system comprising:

at least one tank, feeding lines and at least one feeding pump, the feeding lines feeding raw materials to the at least one tank through the action of the at least one feeding pump;

a respective device for determining the filling level of the at least one tank and for stopping the feeding of raw materials when a given filling level has been reached;

a low level control device which monitors when the at least one tank has reached a given low level to turn on the at least one feeding pump to supply additional raw materials;

a respective stirrer for homogenizing the raw materials in the at least one tank, and including a sufficient number of the feeding lines to feed different raw materials to continuously and automatically fully complete the process of the production of a variety of paints, substantially without human intervention;

a cleaning system for automatically circulating through all of the feeding lines and structural components of the system which contact the raw materials, a cleansing fluid which purges the raw materials associated with the production of a given paint before the commencement of the production of another paint;

wherein the system comprises two main feeding lines (F and G), which receive, alternately and independently, a plurality of different raw materials processed by respective pumps for the different raw materials through respective on-off valves; the two main feeding lines also receiving resin through respective valves which are automatically controlled as to dosage by flow meters, the flow meters having drains which serve to calibrate the flow meters, and including filters and three-way valves which feed mixing tanks, each of said mixing tanks having a respective motorized stirrer; said mixing tanks having a lower outlet pipe and communicating with a respective gear pump and a respective flow meter and two basket filters assembly in parallel being connected in a further three-way valve; a main mixer being coupled to a three-way valve and pressure control valves serving to direct a mixture back to the mixing tanks.

7. The system of claim 6, including a loading system, coupled to the two feeding lines and including respective drums, gear pumps and basket filters for measuring quantities of raw material manually through a weighing scale, with raw materials being added in the mixing tanks through pumping or manual discharge, through a funnel installed in respective nozzles of the tanks.

* * * * *

UNITED STATES PATENT AND TRADEMARK OFFICE

CERTIFICATE OF CORRECTION

PATENT NO. : 6,494,608 B1
DATED : December 17, 2002
INVENTOR(S) : Retamal et al.

It is certified that error appears in the above-identified patent and that said Letters Patent is hereby corrected as shown below:

Title page,
Item [73], please change the name of the Assignee to read as follows:
-- Renner du Pont Tintas Automotivas e Industriais S/A --

Signed and Sealed this

Tenth Day of June, 2003

JAMES E. ROGAN
*Director of the United States Patent and Trademark Office*